US007244040B2

(12) United States Patent
Chen

(10) Patent No.: US 7,244,040 B2
(45) Date of Patent: Jul. 17, 2007

(54) RAILING WITH LIGHT EMITTING DIODES

(75) Inventor: Chun-Ming Chen, Yung Kang (TW)

(73) Assignee: Hsin-Yun Lee, Chu Pei (TW)

( * ) Notice: Subject to any disclaimer, the term of this patent is extended or adjusted under 35 U.S.C. 154(b) by 101 days.

(21) Appl. No.: 11/136,504

(22) Filed: May 25, 2005

(65) Prior Publication Data

US 2006/0268547 A1 Nov. 30, 2006

(51) Int. Cl.
*F21S 8/00* (2006.01)

(52) U.S. Cl. ..... 362/152; 362/431

(58) Field of Classification Search ..... 362/152
See application file for complete search history.

(56) References Cited

U.S. PATENT DOCUMENTS 2,721,255 A * 10/1955 Lanmon ..... 362/146
2,827,561 A * 3/1958 Kennedy, Jr. ..... 362/344
4,438,484 A * 3/1984 Winden ..... 362/267
5,083,791 A * 1/1992 Coombes, Jr. ..... 273/237
5,887,856 A * 3/1999 Everly, II ..... 256/1
6,386,729 B1 * 5/2002 Bober ..... 362/153.1
6,457,847 B1 * 10/2002 LeVasseur ..... 362/351
6,505,950 B1 * 1/2003 Natoli et al. ..... 362/146
6,585,398 B1 * 7/2003 Haddad ..... 362/328

FOREIGN PATENT DOCUMENTS

GB 1480245 * 7/1977

* cited by examiner

*Primary Examiner*—Ali Alavi
*Assistant Examiner*—Hargobind S. Sawhney
(74) *Attorney, Agent, or Firm*—Rosenberg, Klein & Lee

(57) ABSTRACT

A railing with light emitting diodes includes a rod, a base unit secured to the bottom, a lid secured to the top, an illuminating device mounted in the rod, and a controller. The illuminating device is provided with a plurality of lighting units to illuminate as a warning light for passerby to avoid from collision and as a decorative light to beautify the environment.

5 Claims, 3 Drawing Sheets

RAILING WITH LIGHT EMITTING DIODES

BACKGROUND OF THE INVENTION

1. Field of the Invention

This invention relates to a railing with light emitting diodes, more particularly, to a railing provided with lighting units having light emitting diodes for lighting and warning purposes.

2. Description of the Related Prior Art

Conventional Railings have been used widely in public area or at home for the purposes of safety and beautification. However, the railings do not have any lighting system. At nighttime, people may be trapped by the railings, and it exists potential danger to passerby.

SUMMARY OF THE INVENTION

It is the primary object of the present invention to provide a railing with light emitting diodes, which illuminates light at nighttime to warn people from collision.

It is another object of the present invention to provide a railing with light emitting diodes, which can be changed to different colors of light to attract people's eye and to beautify the place.

It is a further object of the present invention to provide a railing with light emitting diodes, which is movable and can be chained to bar unauthorized personal from entering.

BRIEF DESCRIPTION OF THE PREFERRED EMBODIMENT

DETAILED DESCRIPTION OF THE PREFERRED EMBODIMENT

Figure 1:
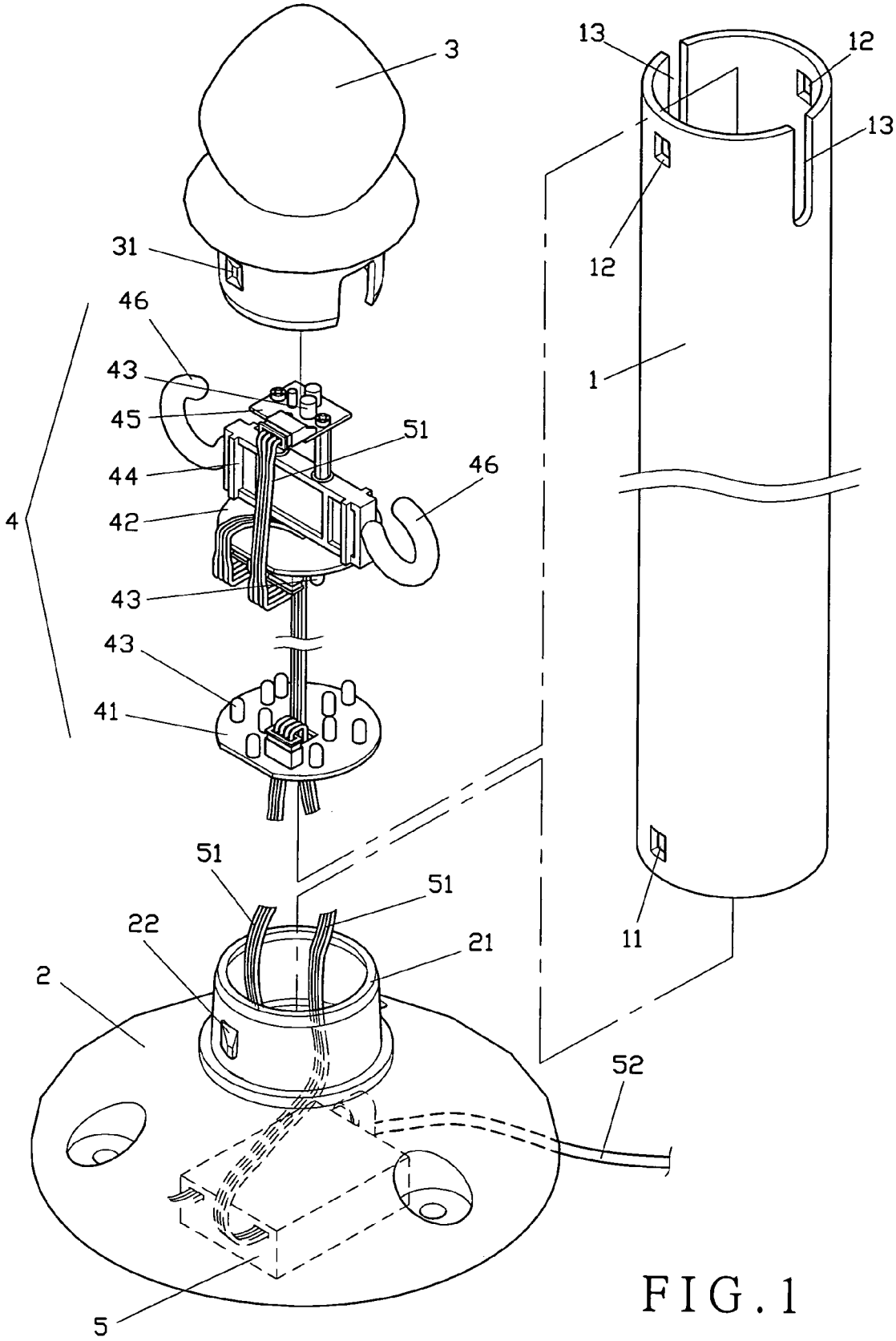
FIG. 1 is an exploded view of the present invention.

As shown in FIG. 1, the present invention comprises a rod 1, a base unit 2, a lid 3, an illuminating device 4 and a controller 5.

The rod 1 is a hollow body and is made of light transparent material. The upper and lower ends of the rod 1 are provided with securing parts 11 and 12, respectively. The securing parts 11 and 12 are securing holes. The top end of the rod 1 is formed with a pair of slots 13 in opposition to each other.

The base unit 2 is coupled to the bottom of the rod 1. The base unit 2 has a hollow body with a flange 21 protruding from the center top portion. The flange 21 is provided with securing parts 22 corresponding to the securing parts 11 at the bottom end of the rod 1. The securing parts 22 are securing blocks.

The lid 3 is connected to the top end of the rod 1 and is made of light transparent material. The lid 3 is provided with securing parts 31 at the bottom end corresponding to the securing parts 12 at the upper end of the rod 1. The securing parts 31 are securing blocks.

The illuminating device 4 is mounted in the rod 1 and is formed by a number of first and second lighting units 41 and 42. The first and second lighting units 41 and 42 comprise a number of light emitting diodes 43 lined up in series. The light from the light emitting diodes 43 can be either identical or different color. The second lighting unit 42 is provided with a block 44 on the top. The block 44 is provided with a third lighting unit 45 on the top. The third lighting unit 45 comprises a number of light emitting diodes 43. The block 44 further comprises a pair of hooks 46 extending from respective sides for connecting purposes.

The controller 5 is mounted and secured in the base unit 2, and comprises a plurality of first electric wires 51 connected to the first, the second and the third lighting units 41, 42 and 45. The controller 5 further comprises a second electric wire 52 connected to an external power supply which can either be a wall outlet of alternating current or a battery of direct current to supply electric power for activating the light emitting diodes 43 of the first, the second and the third lighting units 41, 42 and 45.

Figure 2:
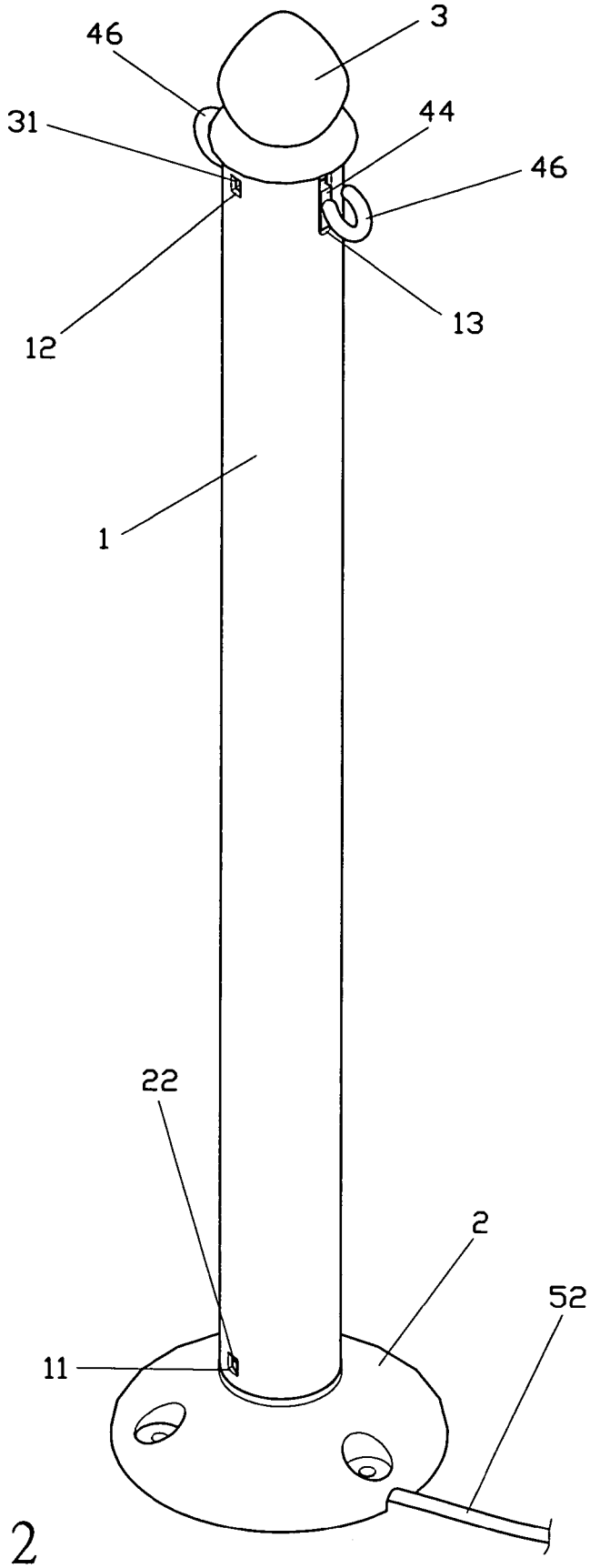
FIG. 2 is a perspective view of the present invention.
Figure 3:
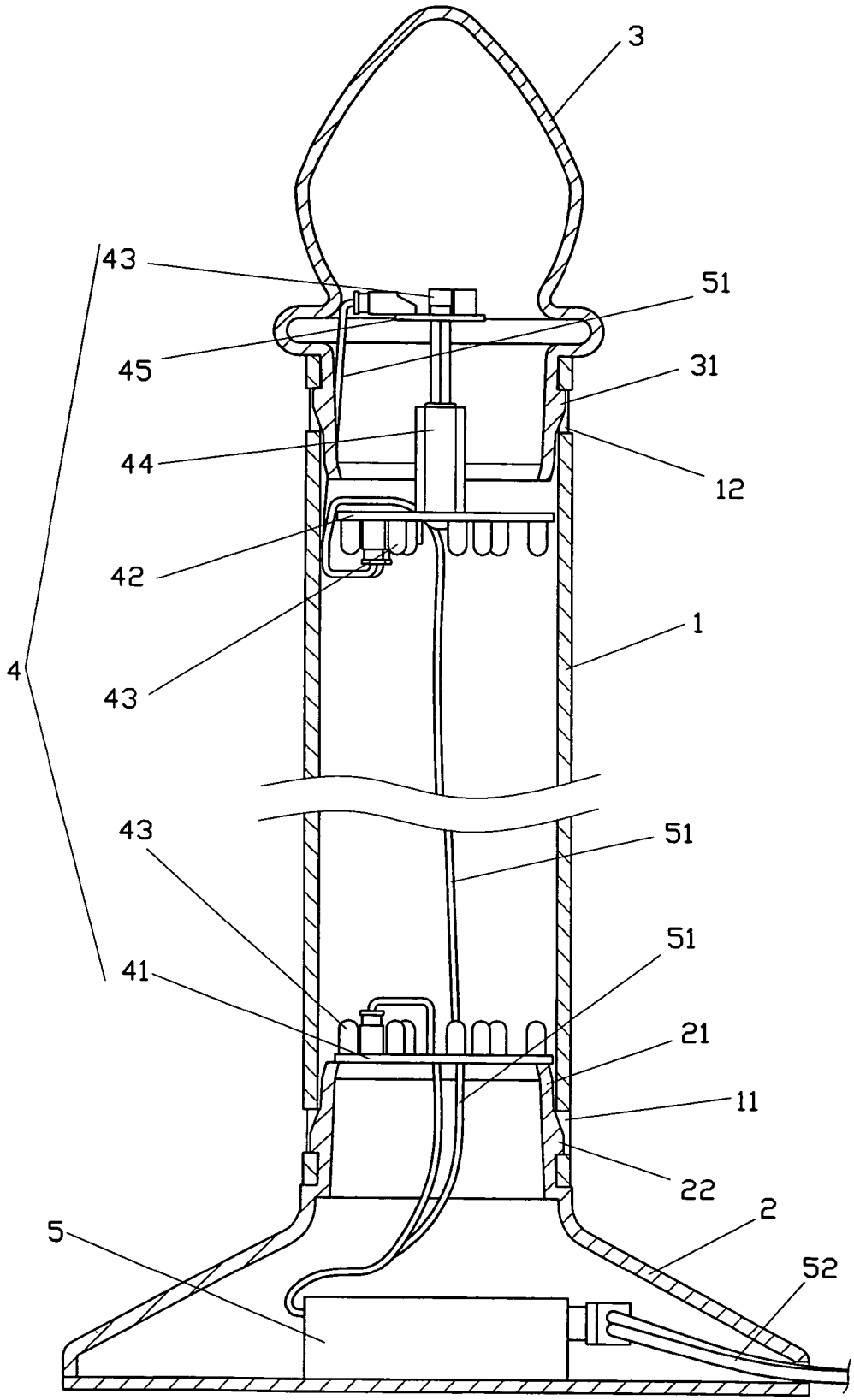
FIG. 3 is a cross-sectional view of the present invention.

To assemble the present invention, as shown in FIGS. 2 and 3, the controller 5 is secured in the base unit 2 with the first electric wires 51 connecting to the first, the second and the third lighting units 41, 42 and 45. The base unit 2 is inserted to the bottom of the rod 1 with the securing parts 22 engaging with the securing parts 11 of the rod 1 to secure the base unit 2 thereat. The first lighting unit 41 is seated immediately on the flange 21 of the base unit 2. The block 44 on the second lighting unit 42 is inserted into the slots 13 of the rod 1, which hangs the second lighting unit 42 to the top position of the rod 1. The lid 3 is connected to the top of the rod 1 with the securing parts 31 engaging with the securing parts 12 of the rod 1 to secure the lid 3 thereon.

To operate the present invention, as shown in FIG. 3, the second electric wire 52 is connected to an outside electric power supply. The electric power will be transferred from the second electric wire 52 through the first electric wires 51 to activate the light emitting diodes 43 of the first, the second and the third lighting units 41, 42 and 45. The light illuminated from the first lighting unit 41 penetrates the bottom portion of the rod 1, while the second lighting unit 42 lights up the top portion of the rod 1, and the third lighting unit 43 illuminates the lid 3. The lighting can be seen in the dark easily to prevent passerby from collision. Furthermore, the different colors of the lighting are attractive and can be a decorative design.

The rod 1 of the present invention is moveable. Therefore the user may place a number of rods 1 at different occasions and use the hooks 46 of the block 44 to link the rods together to bar unauthorized people from entering.

I claim:

1. A railing with light emitting diodes comprising:

a rod made of light transparent material comprising securing parts at respective upper and lower ends thereof;

a base unit comprising securing parts corresponding to said securing parts at the lower end of said rod;

a lid made of light transparent material comprising securing parts corresponding to said securing parts at the upper end of said rod;

an illuminating device mounted in said rod comprising lighting units, said lighting units comprising light emitting diodes, and a controller secured in said base unit comprising first electric wires connected to said lighting units and a second electric wire connected to an external electric power supply wherein said rod comprises a pair of slots at top end in opposition to each other, one of said lighting units comprises a block to be inserted and secured in said slots of said rod.

2. The railing with light emitting diodes, as recited in claim 1, wherein said securing parts of said rod are securing holes, and said securing parts of said base unit and said lid are securing blocks to engage with said securing holes.

3. The railing with light emitting diodes, as recited in claim 1, wherein said base unit comprises a flange to secure one of said lighting units thereat.

4. The railing with light emitting diodes, as recited in claim 1, wherein said block comprises a pair of hooks extending from respective sides thereof.

5. The railing with light emitting diodes, as recited in claim 1, wherein one of said lighting units includes a hook projecting outward therefrom through said rod.

* * * * *